US006884099B1

(12) United States Patent
Cannon

(10) Patent No.: US 6,884,099 B1
(45) Date of Patent: Apr. 26, 2005

(54) POSITIVE LOCKING PUSH-ON PRECISION BNC CONNECTOR FOR AN OSCILLOSCOPE PROBE

(75) Inventor: James E. Cannon, Colorado Springs, CO (US)

(73) Assignee: Agilent Technologies, Inc., Palo Alto, CA (US)

( * ) Notice: Subject to any disclaimer, the term of this patent is extended or adjusted under 35 U.S.C. 154(b) by 20 days.

(21) Appl. No.: 10/764,928

(22) Filed: Jan. 26, 2004

Related U.S. Application Data

(63) Continuation of application No. 10/764,928, filed on Jan. 26, 2004.

(51) Int. Cl.[7] ..... H01R 13/62
(52) U.S. Cl. ..... 439/318; 439/314
(58) Field of Search ..... 439/314–323

(56) References Cited

U.S. PATENT DOCUMENTS 3,994,552 A * 11/1976 Selvin ..... 439/278
4,708,661 A * 11/1987 Morland et al. ..... 439/77
5,785,545 A * 7/1998 Holt ..... 439/352
5,857,866 A * 1/1999 Felps ..... 439/289
6,095,841 A * 8/2000 Felps ..... 439/312
6,305,963 B1 * 10/2001 Felps ..... 439/317
6,358,078 B1 * 3/2002 Crippa ..... 439/321
6,517,359 B1 * 2/2003 Felps et al. ..... 439/63
6,602,093 B1 * 8/2003 Cannon ..... 439/578
6,609,925 B1 * 8/2003 Cannon ..... 439/332
6,783,382 B2 * 8/2004 Felps ..... 439/314
6,790,080 B2 * 9/2004 Cannon ..... 439/551

* cited by examiner

*Primary Examiner*—Ross Gushi
(74) *Attorney, Agent, or Firm*—Edward L. Miller

(57) ABSTRACT

The push-on latching function of a male BNC latch carried in a housing, and the positive locking of fully mated male and female connectors, are performed by three parts: The first is a male double shell assembly having two male sleeves that receive an intervening BNC female shell. An outer portion near the middle of the male double shell carries several turns of an exterior left-hand thread. The second is a spring biased self-latching BNC latch having an interior bore by which it snugly engages, and then rotates upon, the exterior of the male double shell. One end of the BNC latch has ramps and detents for engaging the bayonet pins of a female BNC connector, and the other end has a section of exterior right-hand threads proximate the exterior left-hand threads of the male double shell. The third is a barrel that has a bore therethrough with both left and right hand internal threads that engage the exterior threads of the BNC latch and the male double shell. Rotation of the barrel in one direction causes the BNC latch to move toward the male double shell, and pulls the male assembly toward the female connector for full and locked mating.

7 Claims, 5 Drawing Sheets

POSITIVE LOCKING PUSH-ON PRECISION BNC CONNECTOR FOR AN OSCILLOSCOPE PROBE

REFERENCE TO RELATED APPLICATIONS

The subject matter of this disclosure is related to that which is disclosed in U.S. Pat. No. 6,095,841 entitled PUSH-LOCK BNC CONNECTOR, filed 20 Mar. 1998 by Jimmie D. Felps, was issued 1 Aug. 2000, and assigned to Agilent Technologies of Palo Alto, Calif. Because of the similarity in subject matter, and for the sake of brevity in the present case, U.S. Pat. No. 6,095,841 is hereby expressly incorporated herein by reference, and will be referred to either as "PUSH-LOCK BNC CONNECTOR" or as "the incorporated '841 patent" or perhaps merely as ". '841" where the context excludes any ambiguity.

The subject matter of this disclosure is also related to, and makes use of, that which is disclosed in U.S. patent application Ser. No. 10/284,226 entitled PUSH-LOCK PRECISION BNC CONNECTOR, filed 29 Oct. 2002 by Jimmie D. Felps and assigned to Agilent Technologies of Palo Alto, Calif. Because of the similarity in subject matter, and for the sake of brevity in the present case, the U.S. patent application Ser. No. 10/284,226 is also hereby expressly incorporated herein by reference, and will be referred to either as "PUSH-LOCK PRECISION BNC CONNECTOR" or as "the incorporated '226 application".

For the same general reasons, U.S. Pat. No. 6,609,925, issued 26 Aug. 2003, entitled PRECISION BNC CONNECTOR, filed 30 Apr. 2002 by James E. Cannon and assigned to Agilent Technologies of Palo Alto, Calif., is also hereby expressly incorporated herein by reference, and will be referred to as "PRECISION BNC CONNECTOR" or as "the incorporated '925 patent".

BACKGROUND OF THE INVENTION

The present invention concerns the confluence of two issues related to high frequency test equipment, and in particular, to test equipment where individual coaxial connectors are used to connect a detachable probe to that equipment. One example is present day high performance oscilloscopes.

Issue #1

The first issue concerns what series connector is used, especially for probes or for direct connections to signals to be measured by the test equipment, and that are not merely an ancillary part of a test set-up. It is customary for scopes (and some other types of test equipment) to employ BNC connectors for their front and rear panel connections. The BNC connector has a number of attractive features that, so far anyway, have outweighed its disadvantages. These attractive features include: ease of use (a quarter twist to mate or un-mate); size small enough to not consume too much panel space (but not so small as to be mechanically delicate); reasonable cost and widely established use with many manufacturers; and, many mounting styles to choose from. It is also a controlled impedance connector, and is available in the commonly used values of 50 Ω and 75 Ω. For a given characteristic impedance, any BNC connector will (in theory, anyway) mate with one of the opposite gender, regardless of who the manufacturers were or what the mounting styles are. In many respects it is the workhorse of the general electronics industry; if it wasn't at hand we'd have to invent it. Nevertheless, and despite its longevity and venerable origin [the Bayonet Navy Connector (BNC) was developed for the US Navy during WW II] it has begun to reveal certain shortcomings. The following several paragraphs relating to the shortcomings of the conventional BNC connector, and an attractive solution therefor, have been abstracted from PRECISION BNC CONNECTOR.

Despite its popularity, the BNC connector has some significant drawbacks when used as an instrument grade connector for some electronic test equipment, such as top of the line high frequency oscilloscopes. It has reactive discontinuities at high frequencies. That is, above certain frequencies it fails to match the 50 Ω characteristic impedance of the coaxial transmission line of which it is expected to be a part. Even the most carefully installed silver-plated mil-spec clamp type BNC connector is extremely visible as a discontinuity on a TDR (Time Domain Reflectometer) of even modest bandwidth. Next, it tends to "leak" (radiate from its mating surfaces) above, say, 500 MHZ. Finally, since it relies solely on internally supplied spring tension to draw its parts together, it can, when under externally applied tension, allow the mating parts to separate sufficiently to degrade the quality of the connection (greater discontinuity, more loss), sometimes to point where the connection is interrupted altogether (especially if the parts are worn from extended use).

Many of the problems of BNC connectors can be traced to aspects in the design of the male half, which is to say, the part that has the male center conductor pin and that is given the quarter turn twist while gripping a knurled shell we shall call a bayonet latch. Let us briefly take a closer look at the conventional BNC connector, the better to appreciate why it has these problems.

The female connector portion includes a female center pin that is centered and held in place by an enclosing Teflon female sleeve. The female sleeve has a reduced diameter portion in front, and toward the rear has a stepped diameter that engages a corresponding shoulder in a female shell. The female sleeve is secured in place from the rear in various ways, depending upon the style and manufacturer. The reduced diameter portion in front will be of interest, shortly.

Now consider the male connector half. As an assembly, it includes a Teflon male sleeve whose rear portion has a small diameter bore that centers and supports a male center pin, and whose front portion has a larger diameter bore sized to just slip over the reduced diameter portion of the female sleeve. When the connector halves are properly mated the two Teflon sleeves are not only in contact over adjacent cylindrical surfaces, but the female sleeve "bottoms out" inside the male sleeve. (The terms "male" and "female" are applied to component parts according to the connector halves as a whole, and its gender is determined by the shape of the center conductor pin. Viewed in isolation, the "male" Teflon sleeve might be thought to be "female", as it surrounds the outside of the "female" sleeve when the connector halves are mated. But it is part of the male connector half. So it is that the male sleeve has a female shape, but is still called the male sleeve.) Potential gender confusion aside, the important thing is that when proper mating occurs there are edges and surfaces of the sleeves that "vanish" to form one (i.e., unitary) longer tube of Teflon that will be the dielectric material disposed between the center conductor and the outer shield forming the coaxial transmission line.

A similar thing happens to the center pins that they carry. The male pin has a reduced diameter tapered tip that enters a cavity, or socket, centered in the end of the female center conductor. The cavity is slightly undersize, but the end of the female socket is slit to allow a slight resilient outward motion that promotes good ohmic contact between the pins. The thus-expanded outer diameter of the female center pin is the same as that of the male center pin, so that when they are fully mated a shoulder on the male pin and the face of the female pin "disappear" as each of the two pins presses against the end of the other, and the pins appear to be one (unitary) longer cylindrical center conductor. The two sleeves of dielectric material and the two pins are supposed to fully mate simultaneously, for if one were to mate before the other it would prevent the further motion needed by the other to become fully mated.

Surrounding and carrying the sleeves are respective cylindrical outer shells, one male and one female. The male outer shell has a collection of slits so that they can bend inward slightly under compression as they enter a female outer shell of slightly insufficient diameter. This provides good ohmic contact for maintaining the outer shield of the coaxial system. Once again, the male outer shell is expected to bottom out against a shelf of stepped diameter within the female outer shell, so that (save for the slits) the mated pair of outer shells appears as a complete unitary cylinder of uniform inner diameter as the end of the male outer shell vanishes against the shoulder inside the female outer shell.

A pair of bayonet pins on the outside of the female outer shell engage detents at the end of a quarter turn spiral groove in a rotatable captive bayonet latch carried on a male connector shell. Depending upon the particular design, a spring located somewhere in the above described elements provides a resilient force that pulls the center pins, sleeves and outer shells together once the detents in the bayonet latch contain the bayonet pins. If everything is working correctly, no RF currents flow through the connection between the bayonet pins and the bayonet latch; all RF currents would flow exclusively through the center pins and the outer shells. Unfortunately, pulling on the cable, or otherwise inducing external tension urging the two connector halves apart, can overcome the internal spring tension keeping the connectors halves together. If a sufficient tension is applied the connector halves will draw apart slightly, disturbing the uniform inner diameter of the mated outer shells and possibly introducing an increased ohmic component in the connection.

There are two basic aspects that we wish to point out. First, the tapered end of the male center pin enters a slitted socket in the end of female pin, and ordinarily spreads those slit portions apart slightly, for good contact. As the connector wears the diameter of the tapered end portion of the male center pin and the resilience in the slit female pin are both reduced, while the inner diameter of the female pin is increased, so that a slight withdrawal of the male pin can significantly decrease the ohmic quality of the connection. Equally as bad at higher frequencies, as the withdrawal occurs, there appears a short length over which there is a marked decrease in center pin diameter. That is, the male and female center pins have the same outer diameter, and when they are fully mated there are annular surfaces that touch, shoulder to shoulder. When that occurs there is no, or very little, effective change in the outer diameter of the combined center pins. When these shoulders do not touch there is an immediate reduction in diameter to that of the tapering end of the male pin. A similar increase in the effective diameter of the outer shell occurs also, as the end of the male outer shell pulls away from the shoulder in the female outer shell that it seats upon. These changes are important, since the characteristic impedance of a coaxial transmission line involves the ratio of the outer diameter of the center conductor and the inner diameter of the outer conductor, as moderated by the dielectric constant therebetween. When the male center pin withdraws slightly from the female pin, the short length of diameter reduction occurs at about one quarter of an inch from the location where the short length of outer diameter increase occurs, and this "double whammy" appears as a very definite discontinuity. A similar bad thing happens in connection with the Teflon sleeves. Ordinarily, the reduced diameter section of the female sleeve would be the exact complement of the large diameter portion of the male sleeve. The idea is that when they mate their edges vanish, as it were, and the two parts act as a single part of continuously present material of the proper diameter. That fails when the connector halves pull apart, producing another discontinuity owing to a location of altered dielectric constant. This happens adjacent where the center pins have their "diameter fault," increasing the resulting discontinuity. Furthermore, the presence of the Teflon is a bit of a problem in the first place, since it is difficult to machine the stuff to the tolerances needed to reliably perform the magic of the vanishing edges. Also, it is the Teflon that is supposed to hold the center conductor pins in their proper locations. Not only is Teflon difficult to machine to tight tolerances, but it won't hold them over time, even if it could be done, since Teflon cold flows so easily. Even a brand new connector, but especially a used connector, will have Teflon sleeves that exhibit and account for significant mating anomalies at frequencies above, say, 500 MHZ. This is no longer a minor matter.

Here now is a brief summary of how the improved BNC connector described in PRECISION BNC CONNECTOR solves these problems. Here is the Summary Of The Invention from that Disclosure:

> "A solution to the problem of poor RF performance in the conventional BNC connector is to first, eliminate the use of Teflon, in favor of an air dielectric in the vicinity of the mating parts, and support the male and female center pins further back within the body of the connector, using other proven dielectric materials borrowed from the precision type N connector, or from another 7 mm RF connector. Next, a captive knurled draw nut provides positive displacement and the tension needed to draw the already mated male and female connector halves together, in place of the conventional spring tension. It is the bottoming out of the male shell inside the female shell that resists the positive displacement and the tension supplied by the knurled draw nut, ensuring that the two connector halves are actually in contact, and that the edges of surfaces that need to "vanish" for good operation do indeed vanish. The mating center conductors are rigidly mounted within their shells and bottom out against each other at the same time as do the shells. The basic bayonet latch mechanism is retained, so that either half of the new connector will mate with opposite sex halves of conventional BNC connectors."

Today, many oscilloscopes operate at ten times the frequency at which conventional BNC connectors begin to exhibit degraded performance, and some operate considerably higher. There is, in fact, a large installed base of such oscilloscopes that use a conventional BNC connector. These high frequency scopes use active probes that perform, among other things, impedance conversion, so that the signal can be supplied to the scope over an intervening 50 Ω transmission line, which is the cable that connects the probe to the scope. We are now faced with a situation where the connector of choice is a principal limitation in the overall performance of the scope/probe combination. It is true that there are other RF connectors that would solve the problem of the rotten RF connection, but they are unsuitable for one or more reasons. Some are simply too expensive, and, it will be noted, the expensive ones tend to be threaded and/or easily damaged; APC 3.5 connectors come to mind in this regard. Precision type N connectors would carry the signals all right, but they, too, are threaded, and besides being moderately expensive, they take a lot of panel space. The old GR-874 "sexless" and "push-on" connector even comes to mind. It was (and still is!) a pretty good connector, and perhaps when in good condition is even comparable to a "precision" type N. But it is as big or bigger than N, is more expensive, and sadly, seems to be on the verge of "going away." Well, then, so be it. It would seem that we should switch to the precision BNC connector. (We note that it cooperates, with some degradation in performance, with conventional BNC. That helps lessen the sting of a change to a new style.) We can easily arrange to use the precision female portion on the front panel, since it is essentially a direct replacement. Alas, even if we do, there is yet another fly in the ointment.

Issue #2

The second issue concerns the electrical attachment of scope probes in particular. In the oldest (and by today's standard, largest) passive probes, adjustable compensation was located in the probe body and the cable at the scope end had just a boot acting as a strain relief for protecting a cable mounted male connector. Front panels were big, bandwidth was low, and this was thought to be a tidy solution. Later, for smaller passive probes of higher bandwidth the compensation components were located in a small box at the scope end of the cable, and a bulkhead mount male connector attached the box to the female bulkhead connector on the (smaller) front panel of the scope. Today's very high bandwidth active probe is smaller still, and for some brands the scope end of the cable has a pod or housing the size of a small farm-rat (or at least a large house mouse) that contains a "push-lock" BNC connector of the sort described in either PUSH-LOCK BNC CONNECTOR or PUSH-LOCK PRECISION BNC CONNECTOR. The rat-sized pod also provides mounting for a modest number (six to nine) of other single conductor auxiliary connections between the pod and the front panel. There are many reasons to have this housing in the first place, and good ones for having it abut the front panel of the scope. Probe identification, probe settings, probe power (and possibly, but not necessarily, power return) are all conveyed by these additional connectors (which are essentially spring-loaded pins). The push-lock feature arises from the need to do something to cause the quarter-turn twist that the bayonet locking mechanism requires on the one hand, and the desire to not require rotation of the housing on the other, lest that cause mischief from temporary mis-connection between the spring-loaded pins and their corresponding pads on the front panel. Add to that the circumstance that there is (as a practical matter) no room to get a user's thumb and forefinger in there to rotate an original style BNC latch or the knurled draw nut of PRECISION BNC CONNECTOR. For one thing, the face of the pod or housing should be up against the scope front panel to assist in making the auxiliary connections, while for another, it is sometimes the case that adjacent BNC jacks are located so close together on the panel that, even if there were no rat-sized bulge in the way (and perhaps no auxiliary conductors), it would still be a real aggravation to get that thumb and forefinger in there to twist the BNC latch or the knurled draw nut.

The push-lock BNC connector described in the incorporated '841 patent does address this issue. One merely holds the pod or housing in the hand, and while the connector halves are axially and rotationally aligned, pushes the housing toward the scope. The assembly in the housing that corresponds to the BNC latch twists, but not the pod (which may even have alignment tabs to prevent it). Eventually the detents of the twisting latch align with the bayonet pins of the female connector half on the front panel, and spring bias rotates the latch by an amount sufficient to achieve engaged detents, or "lock" (which is less than the usual quarter turn). To release the male connector/pod the user presses against and rotates a tab or lever with his thumb or a fingertip. The tab is a portion of the BNC latch mechanism that extends out from the pod or housing for just that purpose. Once the latch is rotated to clear the detent, the user simply pulls back on the housing to separate it from the front panel. Unfortunately, despite its ease of use in attaching and detaching it from the scopes front panel, it is still a conventional BNC connector as far as the quality of the transmission line segment formed by the connector is concerned. It still has a slitted outer conductor on the male side, and the lack of a separate deliberate mechanism to draw the halves together means that tension produced from supporting the weight of the pod can cause separation of the center conductors and of the outer conductors. These considerations significantly limit the performance of the scope when higher frequencies are considered.

These same issues are also addressed by PUSH-LOCK PRECISION BNC CONNECTOR. It discloses a solid outer conductor in the male connector, but for forcing the male and female connector halves together relies on an additional ramp section in the mechanism that principally performs the BNC latch function. Because the thumb lever extends through a slot in the pod housing, there is a 90° limitation on the total amount of latch rotation that can be supplied. A substantial part of that is used to perform the standard latching function. Only a remaining fraction of the 90° is available to accomplish the desired locking, which, when combined with standard tolerances for BNC style parts, sets a minimum steepness to the extra locking ramp section. With this minimal degree of steepness (essentially to guarantee a sufficient amount of "throw" or axial displacement to move the connector halves together) there is not always enough mechanical advantage to sustain the needed compressive force produced by the "locking" action, particularly when there is a significant sideways force applied to the pod (produced by, say, a tug on the cable). Furthermore, it is somewhat inelegant in that path through which the compressive force is anchored and applied is more convoluted than direct (the path involves the pod housing, the front panel and the mounting of the connectors themselves). More elements in the path make the tolerance situation worse, and lessen the amount of rigidity that can expected. It would be better if that path for the source of the compressive force urging the two connector halves together could be limited to just the two outer conductors and some element that bridges them. (In other words, if you want to squeeze two things together, squeeze upon them directly, instead of squeezing on other things that happen also to be connected to those two things.)

CONCLUSION

It seems clear, just as was stated in PUSH-LOCK PRECISION BNC CONNECTOR, that what we ought to do is put a male precision BNC connector into the housing, with the intent of preserving the portion of the push-lock technique that automatically engages the BNC detent mechanism. As before, we also wish to avoid the need for using a thumb and forefinger to rotate the cylindrical surface of the knurled draw nut found in PRECISION BNC CONNECTOR. To have to additionally turn (and un-turn!) that knurled draw nut seems like a form of retrograde progress, compared to the ease of use presently associated with the conventional push-lock connector techniques described in the incorporated '841 patent and PUSH-LOCK PRECISION BNC CONNECTOR, not to mention that there may not be enough room for the operator to get his fingers in there, anyway. The "precision BNC" technique has the very desirable potential for 18 GHz performance when both sides are precision BNC, and it even still mates with conventional BNC connectors on existing scopes (although with some reduction in the degree of increased performance, owing to the presence of Teflon, tolerances, etc.). The "push-lock" concept has gained wide acceptance amongst users of high performance oscilloscopes. Yet a more robust locking technique is desirable than that developed for PUSH-LOCK PRECISION BNC CONNECTOR. What to do?

SUMMARY OF THE INVENTION

A housing carries a male push-on precision BNC connector. The push-on latching function (the engaging in detents of the bayonet pins on a female BNC connector) of the male BNC latch carried in the housing, and the positive locking of mated male and female connectors, are performed by three cooperating parts located within the housing:

The first is a male double shell assembly having two male sleeves on a common axis and separated by an annular space large enough to receive an intervening BNC female shell (for the sake of consistency, we are using terminology here established in PUSH-LOCK PRECISION BNC CONNECTOR). The double shell is carried in a fixed position by a probe pod assembly within the housing, and also has provision for carrying an electromechanical transition to a cable that runs from the housing to the probe. An outer portion near the middle of the male double shell carries several turns of an exterior left-hand thread.

The second of the three cooperating parts is a self-latching BNC latch having an interior bore by which it snugly yet easily engages, and is then carried upon, the exterior of the male double shell. It rotates easily thereabout. One end of the self-latching BNC latch has ramps and detents for engaging the bayonet pins of a female BNC connector, and the other end has a section of exterior right-hand threads. The section of exterior right-hand threads is proximate the exterior left-hand threads of the male double shell.

The third cooperating part is a double-acting barrel that has a bore therethrough with both left and right hand internal threads. The double-acting barrel engages and bridges the exterior threads of the self-latching BNC latch and the male double shell. Similar to a turnbuckle, rotation of the double-acting barrel will, when rotated in one direction, cause the self-latching BNC latch to move toward the male double shell, and cause it to move away when the rotation is in the opposite direction. When the self-latching BNC latch has bayonet pins in its detents (i.e., male and female BNC connectors are mated) and moves toward the male double shell, the detent mechanism pulls the entire probe pod assembly toward the (presumably immovable) female BNC connector (on the front panel of an instrument such as an oscilloscope). After less than 90° of barrel rotation the front surface of the inner male shell bottoms out inside a complementary shoulder of the female shell, while simultaneously the center conductors engage fully. At this point the two connector halves are now positively locked together along the axial direction.

The double-acting barrel has a thumb lever that extends through a slot in the pod housing so that the operator can rotate it in both directions. The bridging action of the double-acting barrel adds axial rigidity to the self-latching BNC latch, while also cooperating with a collection of rotational bias and limit mechanisms that keep the un-mated (idle) BNC latch in a correct orientation to begin the mating process, and that ensure un-mating of the BNC detents during the unlocking of the double-acting barrel. One of these mechanisms involve a spring biased and rotatably mounted double-dog that spans respective slots in the facing edges of the self-latching BNC latch and the double-acting barrel. The other mechanism involves a bias spring anchored to the housing that biases an idle double-acting barrel to a ready-to-mate position.

DESCRIPTION OF A PREFERRED EMBODIMENT

Figure 1:
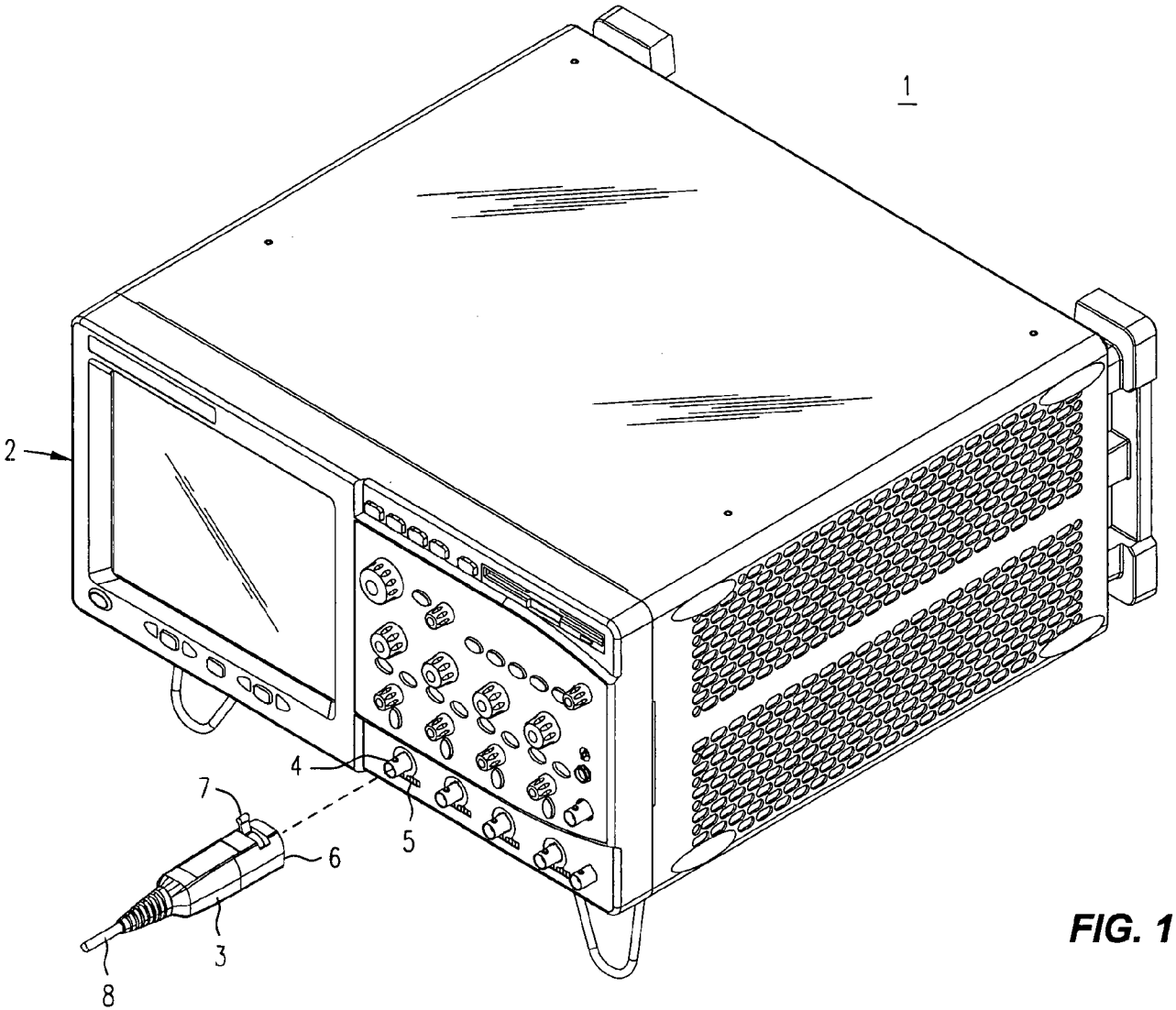
FIG. 1 is a front perspective view of an oscilloscope using a positive locking push-on BNC connector mechanism for a portion of an active probe that attaches to an oscilloscope.

Refer now to FIG. 1, wherein is shown a front perspective view 1 of an electronic instrument 2, such as a digital oscilloscope, having one or more front panel female BNC connectors 4 that receive a positive locking push-on precision male BNC connector assembly 3 (pod housing), say, in support of operation with an active probe (not shown) connected at a distal end of a cable 8. In a manner similar to that explained in the incorporated '841 patent, the positive locking push-on precision BNC connector pod housing is installed by first lining it up and then pushing it toward the scope. That engages the BNC detents, and a simple motion with the thumb against the lever 7 performs a positive locking that fully and forcefully mates the two BNC connector halves. When the pod housing 3 is locked, not only is a precision BNC connection established with connector 4, but a row of spring loaded pins 6 (not visible) on the front of the housing for the push-on assembly 3 engages a row 5 of contacts beneath the connector 4. To remove the positive locking push-on precision BNC connector the operator pushes in the opposite direction on lever or tab 7 with a thumb or a finger, while pulling the assembly (3) away from the scope.

Figure 2:
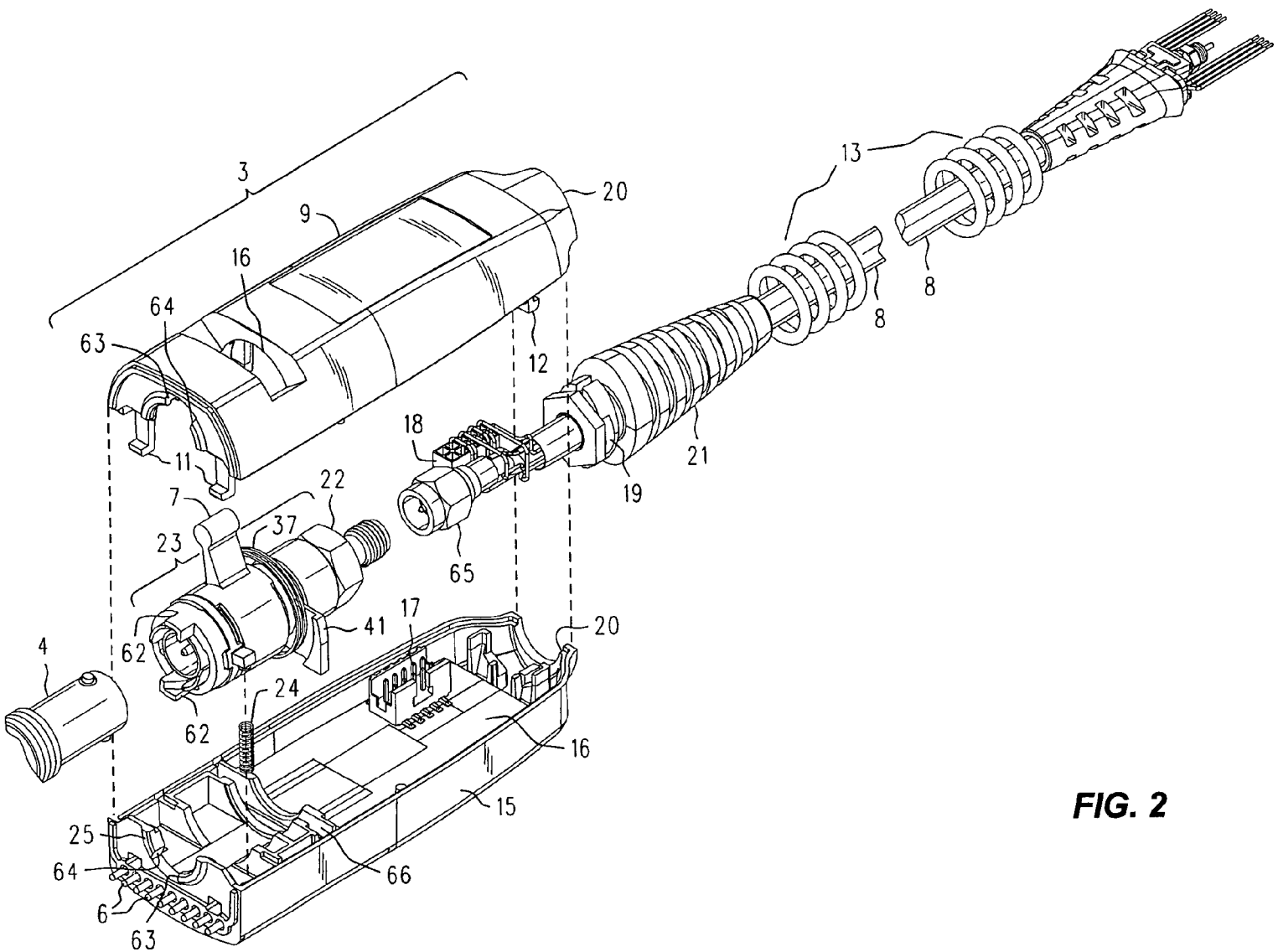
FIG. 2 is an exploded perspective view of the positive locking push-on precision BNC connector of FIG. 1.

Refer now to FIG. 2, wherein is shown an exploded view of the housing 3 of FIG. 1 and its contents. In particular, an upper housing half 9 and a lower housing half 15 cooperate to contain a locking self-latching BNC latch assembly 23, a female RF connector assembly 22 (e.g. using APC 3.5) for connection with a cable 8 that has a probe at a distal end. (We have not shown the probe itself, only a boot and some conductors that attach to it.) The cable 8 connects to connector assembly 22 through its own male connector 65. The cable 8 is further anchored in the housing by the action of a strain relieving boot 21 that is affixed to the cable and that has a narrow neck 19 that is made captive in an aperture (20) in the rear of the housing. Also shown are two sets of flexible colored rubber rings 13 that can be passed by each other to reside upon grooves in the boots. These colored rings serve as reconfigurable probe identifiers.

Besides the coaxial transmission line in the cable 8, there are six to eight other conductors that are part of cable 8, and these are connected to a circuit board 16 in housing half 15 through connectors 18 and 17. The function of these six to eight conductors varies with the model of the probe, and is connected with the function of the row of spring loaded pins 6. Besides power, power return and bias voltages, there are also items of information that are passed by these conductors, such as model numbers, calibration information and serial numbers.

Figure 3:
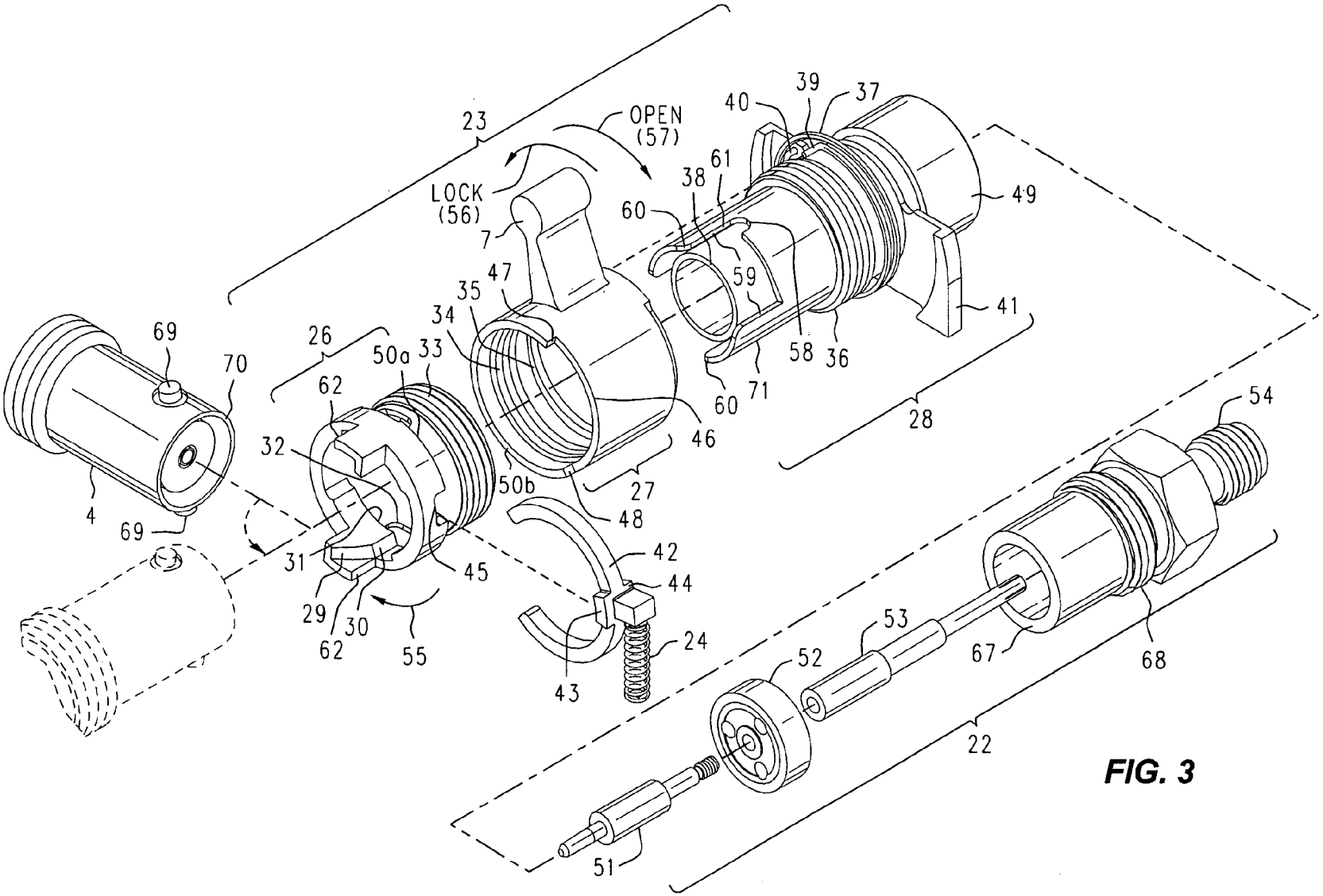
FIG. 3 is an exploded perspective view of a male connector portion of the positive locking push-on precision BNC connector of FIG. 2.

The locking self-latching BNC latch assembly 23 is held in place by a pair of wings 41 (only one of which is visible in FIG. 2) that become captive in a slot 66 in the lower housing half 15. A similar slot (not visible) exists in the upper housing-half 9. These slots are sized to contain the wings 41 with essentially no remaining free motion. We shall much more to say about the operation of the locking self-latching BNC latch assembly 23 in connection with FIG. 3, but there are some features that are better shown in the present FIG. 2 that we point out now for future reference when FIG. 3 is discussed.

In particular, note the front aperture 25. A front portion of the locking self-latching BNC latch assembly 23 (the dogs or prongs having surfaces 62) extends into the aperture 25. The aperture 25 adds some support to the locking self-latching BNC latch assembly 23 while allowing it to rotate. The rotation will arise from action during mating, or from some combination of force from spring 24, spring 37 or the movement of lever 7. The amount of rotation is limited by diameter changes in the aperture at surfaces (or steps) 63 and 64. For example, surface 62 on the locking self-latching BNC latch assembly 23 stops against step 63, and establishes an idle, or "ready to mate," orientation of the locking self-latching BNC latch assembly 23. Step 64 limits rotation in the other rotational direction during locking, and generally is reached only when the locking motion for lever 7 is performed without a female BNC connector (4) having already been latched.

To conclude our description of FIG. 2, note the slot 16 in the upper housing half 9. It allows the lever 7 to extend outside the housing so that it can be actuated by the operator. And finally, note also the hooks 12 and flexible catches 11. Hooks 12 of the upper housing half 9 act as hinges, and engage suitable corresponding recesses (not shown) in the lower housing half 15. Flexible latches 11 of the upper housing engage recessed stepped apertures (not shown) in the bottom of the lower housing half, and snap forward over the steps to hold the two housing halves together. To separate the housing halves, a suitable tool (e.g., the jaws of an open pair of dainty long nose pliers, or the points of a pair of draftsman's dividers) is inserted into the recessed stepped apertures and pressure is applied to move the angled portions of the flexible catches 11 away from the steps. Then the housing halves 9 and 15 are unhinged and separated.

Finally, it will be appreciated that the aperture 25, wings 41 and their slots 66, all combine to hold locking self-latching BNC latch assembly 23 securely in place within the housing 3, even though parts of it are free to rotate.

We turn now to a discussion of FIG. 3 and an explanation of how the locking self-latching BNC latch assembly 23 operates. But first we shall describe its constituent parts and the accompanying connector assembly 22.

Let's begin with the connector assembly 22. It is fully described in PRECISION BNC CONNECTOR, which we summarize here. Dielectric bead 52 is a standard part from 7 mm RF connector practice, and carries center pins 51 (BNC) and 53 (APC 3.5). Dielectric bead 52 is of the same outer diameter as face 67, and is held in place against a stepped shoulder (which is not visible in FIG. 3, but is in FIG. 5) inside male double shell assembly 28. Exterior threads 68 engage interior threads (not visible) inside the rear portion 49 of the male double shell assembly 28, and hold the dielectric bead captive between the stepped shoulder and the face 67. The bead then positions and supports the center pins 51 and 53. See FIG. 5 for a cut-away view.

Assume the male double shell assembly 28 will beheld in a fixed position by wings 41 being captive (as was explained in connection with FIG. 2). It then locates and supports the connector assembly 22 and the other parts we are about to mention. Those other parts will include barrel 27 and BNC latch 26. The male double shell 28 itself has a region of left-hand exterior threads 36, onto which is threaded barrel 27, which has a region of corresponding internal left-hand threads 35. BNC latch 26 is threaded into the front of the barrel. To this end, the BNC latch 26 has a region of external right-hand threads 33 that engage a region of internal right-hand threads 34 within the barrel 27.

During assembly, the two threading operations are accomplished simultaneously while the male double shell is held (perhaps by a fixture), the barrel and BNC latch brought into contact, and the barrel rotated in the direction of the arrow 56 marked LOCK. The reason for this is that the BNC latch 26 cannot fully rotate about the outer sleeve 71 of the male double shell; the raised portions inside its bore that form the ramps 29 and shoulders 31 interfere with the outer sleeve 71, and occupy the space provided by the relieved portion 59 of outer sleeve 71. Once these three parts have been assembled together by the proper number of turns of the barrel 27, they can then by placed into the lower housing half 15.

It will thus be appreciated that the barrel 27 locates and supports the BNC latch 26 relative to the male double shell 28. Of course, exactly where along the axis of the connectors the BNC latch resides is a function of how many threads are engaged, and also of the rotational position of the barrel 27. There are enough threads to provide adequate support, and still leave room for a quarter turn of rotation of the barrel 27 in both directions without things "bottoming out" (and assuming that the BNC latch 26 does not rotate, except as described below). Because of the left and right-hand threads, rotation of the barrel will, since the male double shell 28 is captive and the BNC latch is presumed to be engaged over the bayonet pins of female BNC connector 4 (and thus will not rotate), change the distance that the BNC latch 26 is away from the male double shell 28 (turnbuckle action). In the present embodiment, the threads are 32/inch, so that a 90° rotation of the barrel will cause a displacement of 1/64 inches.

It will also be appreciated that there is, for a particular design, a particular number of the left and right-hand threads that should be present, and that will be engaged in the idle and locked positions. These particulars are matters of design choice, and are clearly within the grasp of one of ordinary skill in the art.

To continue with the recitation of parts, a C-ring 42 snaps into a groove formed by space between surface 50*a* of the BNC latch and surface 50*b* of the barrel 27, after they have been threaded together. The C-ring 42 has a dog 43 that snugly engages a slot 45 in the BNC latch. An opposing dog 44 engages larger slot 46 in the barrel. Note compression spring 24, and refer again to FIG. 2, and then consider that the spring 24 will (via dog 45 and slot 45) bias the BNC latch in the direction of the arrow 56 marked LOCK. While the spring 24 is still somewhat compressed, surfaces 62 will abut steps 63 in the front aperture 25. This action is what pre-positions the BNC latch to engage a female BNC connector 4 whose bayonet pins are oriented vertically, as indicated in the drawings.

Now consider an idle locking self-latching BNC latch assembly (i.e., one that is not mated to a female connector). While the BNC latch 26 is biased as described in connection with compression spring 24, we should also like the lever 7 to be in a suitable unlocked (IDLE) position. To accomplish this is the function of spring 37. One end 40 of spring 37 is anchored in a hole in one of the wings 41, and the other (39) is anchored in a hole (not visible) in the backside of the barrel 27. This is perhaps best seen in FIG. 4. Anyhow, the spring 37 biases the barrel 27 in the direction of the arrow 57 marked OPEN. Refer again to FIG. 2, and note that slot 16 in upper housing 9 limits the throw of lever 7 (in both directions). As a consequence, spring 37 attempts to bias the barrel 27 in the OPEN direction until the lever 7 would rest against the side of the slot 16, which is the full OPEN or RELEASE position of lever 7. However, to get to that extreme position spring 24 would have to be compressed, and spring 37 is not strong enough to overcome spring 24. So the lever 7 stops about 15° before the full OPEN position. Call that the IDLE location for the lever 7. It is also at the IDLE position that step 47 in large slot 46 contacts dog 44. Note that further rotation in the OPEN direction past IDLE will compress spring 24 until the lever 7 is limited by the slot 16. Note also that rotation of the lever 7 from IDLE and in the LOCK direction will leave undisturbed the dog 44, and thus the C-ring and the BNC latch. At the extreme end of the LOCK direction the step or shoulder 48 will approach the other side of dog 44. It will at about that same time that the slot 16 limits the lever 7 to no further movement in the LOCK direction, even if there is no other cause that limits it sooner (i.e., a mated female connector).

So, here is how it all works in operation. Assume that the locking self-latching BNC latch assembly 23 is idle, and that the positions of the BNC latch 26 and the barrel 27 are as described above, with the lever 7 in the IDLE position. As the locking self-latching BNC latch assembly 23 is moved forward toward the female BNC connector 4, the outer annular surface 70 of that female connector will enter the bore through the BNC latch 26. Shortly thereafter, the bayonet pins 69 will contact the ramps 29, rotating the BNC latch in the direction of arrow 55 and (via slot 45 and dog 43) compressing spring 24. After further penetration, the bayonet pins are past the ramps, and enter straight slots 30 (only one of which is visible). During this time further penetration of the female connector 4 does not produce any change in the rotation of the BNC latch 26, and the bayonet pins pass rounded corners 60 and then along edges 61 of the outer sleeve 71 of the male double shell, toward recesses 58. It is also during this time that the spring loaded pins 6 compress to make good contact with their contacts (5) on the scope. However, after the bayonet pins clear the straight slots 30 the spring 24 (again via dog 43 and slot 45) rotates the BNC latch back in the opposite direction, so that it is as it was before the penetration began. (In this connection the left-handedness of the threads 33 and 34 is useful, in that rotation of the BNC latch back tends to move the shoulders 31 away from the bayonet pins 69 rather than toward them, so that they are less likely to drag.) This establishes a detent condition, as the bayonet pins (which have not rotated) are now trapped behind steps or shoulders 31 and in the recesses 58. The recesses 58 ensure that the male connector half will not rotate relative to the female connector half. The locking self-latching BNC latch assembly 23 is now captive to the female BNC connector 4 (and the connection of pins 6 to contacts 5 is assured), but the two BNC connector halves are not yet LOCKED. This automatic production of the detent condition (self-latching) is the substance of the PUSH-ON idea of the Title.

To lock the two connectors the operator now moves the lever 7 in the direction of the arrow 56 marked LOCK. Typically, it will move about an eighth of a turn, and then no further: the decrease in distance between the BNC latch 26 and the male double shell 28 forces the female BNC connector 4 and the interior of the male double shell into intimate contact, as described in the Background and Summary and in the incorporated Patents (the vanishing edges trick). That is, surfaces or shoulders 31 will move toward the male double shell. Surfaces 31 are in contact with the bayonet pins 69, and that urges the two connector halves together. As the male double shell is pulled toward the scope and female BNC connector 4, and the outer annular edge 38 of the male shell moves into, and stops firmly against, the corresponding shoulder in the BNC connector 4. This is the POSITIVE LOCKING of the Title. The mechanical advantage of the threads 33, 34, 35 and 36 is such that it definitely stays locked until the lever 7 is again moved in the direction of the arrow 57 marked OPEN.

To unlock the connectors, the lever 7 is moved fully in the direction of the arrow 57 marked OPEN. This first releases the compression forcing the connector halves together, and then, when shoulder 47 strikes dog 44, compresses spring 24 and (via dog 43 and slot 45) rotates the BNC latch 26 in the direction opposite arrow 55 to again place the straight slots 30 in line with the bayonet pins 69. With this release of the detent action, the pod 3 can be pulled away from the front panel of the scope and off the female BNC connector 4. When the lever 7 is released the spring 24 returns the BNC latch and its lever 7 to the IDLE position (surfaces 62 against shoulders 63) where the ramps 29 are again aligned to receive the bayonet pins 69. The large cut-out regions 59 in the outer shell of the male double shell are to allow for the presence and rotation of the raised sections on the inside of the bore of the male BNC latch 26 from which are formed the ramps 29, straight slots 30 and detent shoulders 31.

Figure 4:
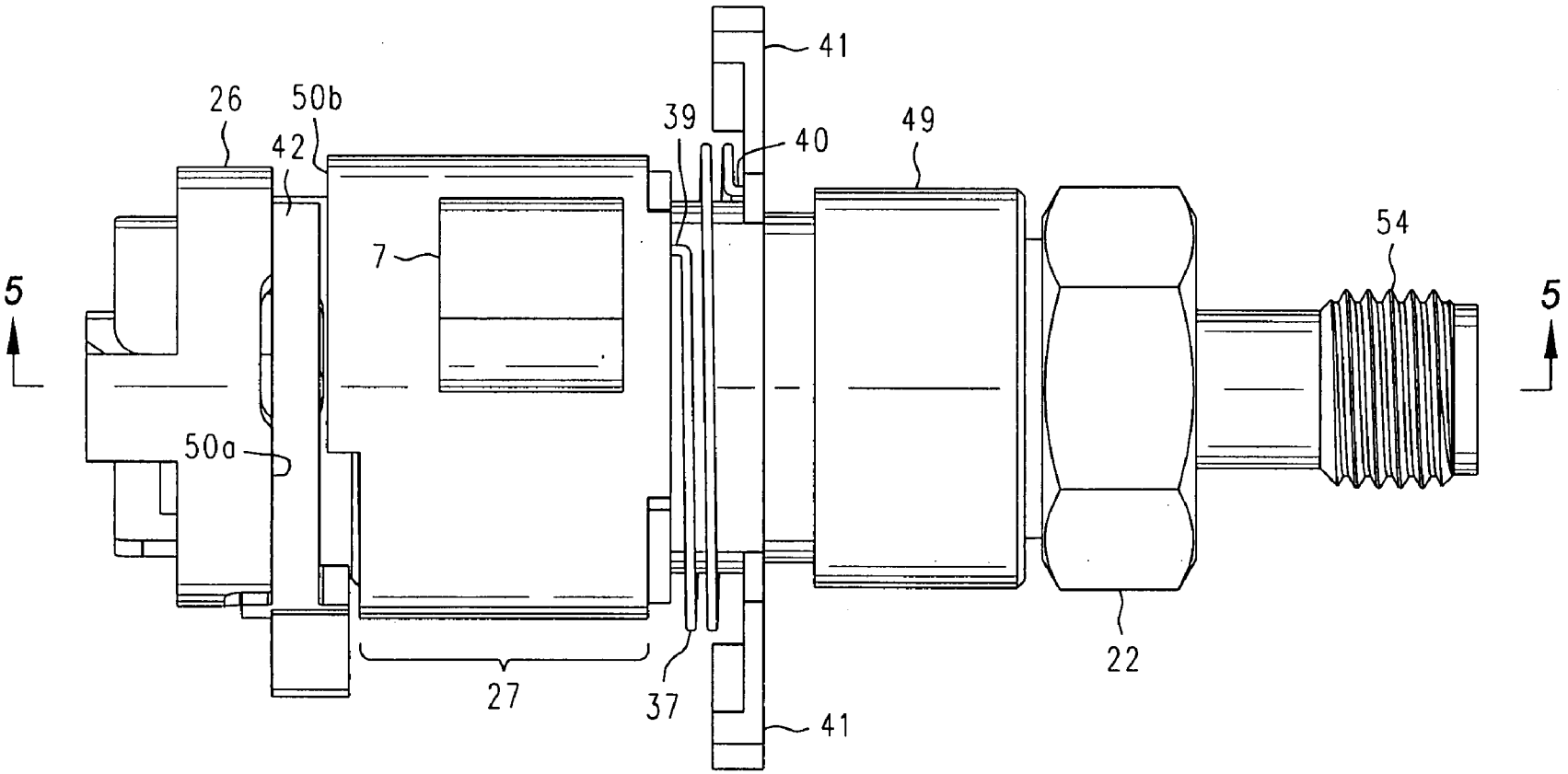
FIG. 4 is a top view of the positive locking push-on precision BNC connector portion shown in FIG. 3.
Figure 5:
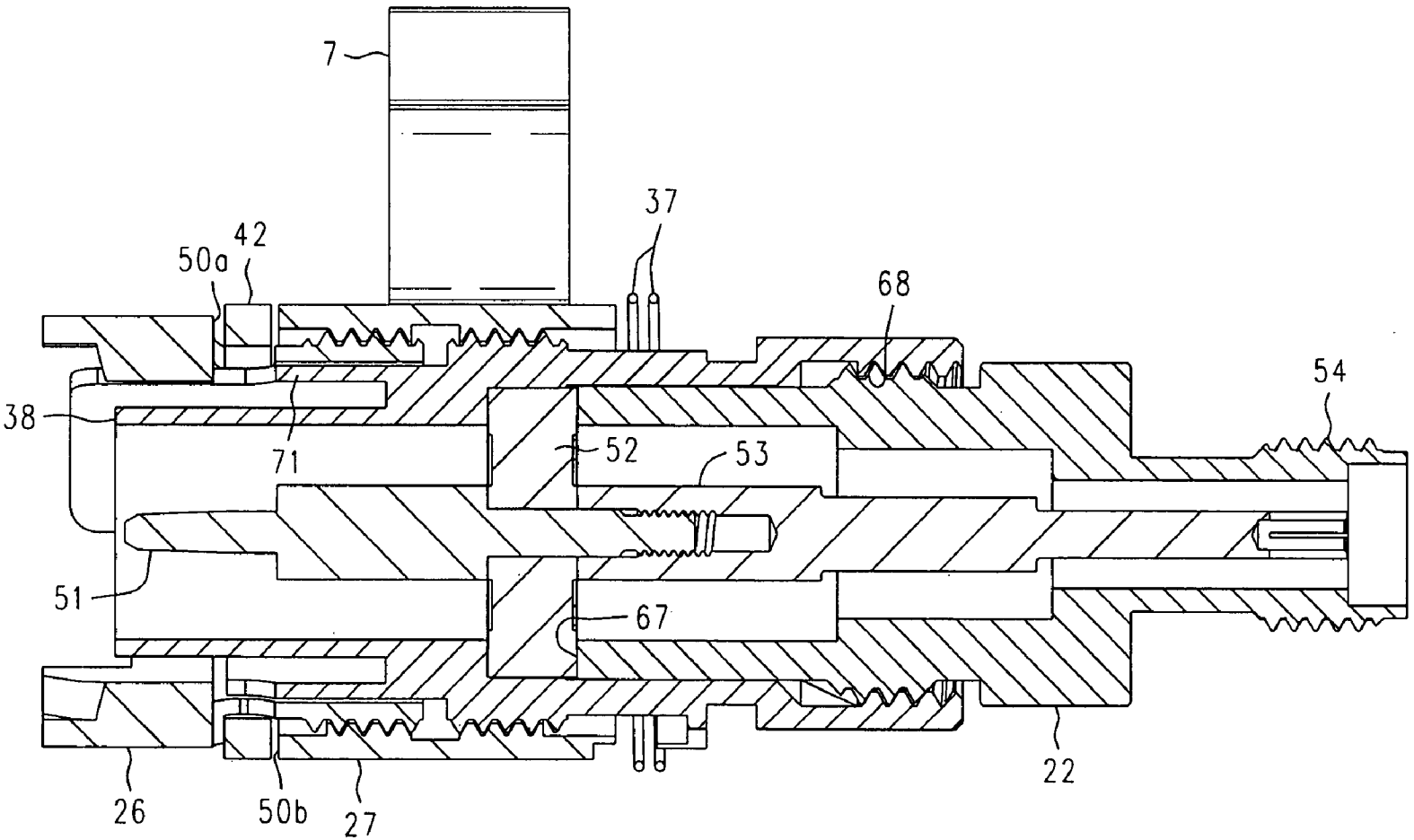
FIG. 5 is a side cut-away view of the positive locking push-on precision BNC connector shown in FIG. 4.

The reader is urged to consult the top view of FIG. 4 and the cut-away side view of FIG. 5. There is not any new material presented there, but the some of the relationships described above are better seen in those views.

Finally, we acknowledge some variations that are within the scope of this disclosure. These include the use of the double-acting barrel (turnbuckle) for other connectors styles that also use bayonet pins, or for other connector styles that use some other form of catch on one half and mating latch on the other, where the conductors can be drawn together by pulling with a double-acting barrel attached to either of the latch or the catch. It is also clear that the use of an automatic latching mechanism is separate from the notion of the positive locking provided by the double-acting barrel, and that either might be present without the need for the other, although their presence as a combination is certainly an attractive arrangement.

It will also be appreciated that the RF connector assembly 22 (including items 54 and 65) are advantageously of a treaded variety, but that such need not necessarily be the case. A push-on connector, such as SMP, SMB or SMC could be utilized, as well. Furthermore, our mention of APC 3.5 will be understood to embrace SMA as well, since the two are outwardly generally identical.

I claim:

1. A method of locking two mated connectors together, the method comprising the steps of:

mating the two connectors by engaging a latch mechanism on one connector with a corresponding latch mechanism on the other;

rotating a threaded member that has left-hand and right-hand threaded portions, one of which portions is threadably coupled to a stationary end of one of the connectors, and the other of which portions is threadably coupled to the latch mechanism of that one of the connectors; and drawing the two mated connectors together with tension when the threaded member is rotated in a first direction and relaxing the tension when the threaded member is rotated in a direction opposite the first direction.

2. A positive locking male BNC connector comprising:

a housing;

a male shell, carried by the housing, having inner male sleeve and also having a first region of external threads of a first handedness;

a male center pin assembly disposed within the inner male sleeve;

a BNC latch having a bore therethrough for sliding onto and rotating about the male shell, and having a second region of external threads of a second handedness opposite the first handedness, and also having slots and detents on the interior of the bore for engaging the bayonet pins of a female BNC connector with which the positive locking male BNC, connector is to be mated;

a barrel having a bore therethrough within which is a third region of internal threads that engage the first region of external threads and also a fourth region of internal threads that engage the second region of external threads; and wherein rotation of the barrel in one direction draws a mated female BNC connector whose bayonet pins are engaged in the detents of the BNC latch toward the male shell until the inner male sleeve bottoms out inside the female BNC connector.

3. A self-latching and positive locking male BNC connector comprising:

a housing;

a male double shell, carried by the housing, having inner and outer male sleeves on a common axis and separated by an annular space and also having a first region of external threads of a first handedness;

a male center pin assembly disposed within the inner male sleeve;

a BNC latch having a bore therethrough for sliding onto and rotating about the outer male sleeve, and having a second region of external threads of a second handedness opposite the first handedness, and also having ramps, slots and detents on the interior of the bore for engaging the bayonet pins of a female BNC connector with which the positive locking male BNC connector is to be mated;

a barrel having a bore therethrough within which is a third region of internal threads that engage the first region of external threads and also a fourth region of internal threads that engage the second region of external threads; and wherein rotation of the barrel in a first direction draws a mated female BNC connector whose bayonet pins are engaged in the detents of the BNC latch toward the male double shell until the inner male sleeve bottoms out inside the female BNC connector.

4. A self-latching and positive locking male BNC connector as in claim 3 further comprising a resilient bias mechanism coupled between the BNC latch and the housing and that urges an idle BNC latch against a stop and into a selected rotational position relative to the bayonet pins of the female BNC connector that is to be mated to.

5. A self-latching and positive locking male BNC connector as in claim 3 further comprising a resilient bias mechanism coupled between the barrel and the housing and that urges the barrel to rotate in a direction opposite the first direction.

6. A self-latching and positive locking male BNC connector as in claim 3 wherein the male center pin assembly further comprises a male BNC end and a second end that is the center pin of another RF connector disposed on a non-BNC end of the self-latching and positive locking male BNC connector.

7. A self-latching and positive locking male BNC connector as in claim 3 wherein the female BNC connector is disposed upon an oscilloscope.

* * * * *

UNITED STATES PATENT AND TRADEMARK OFFICE

CERTIFICATE OF CORRECTION

PATENT NO. : 6,884,099 B1
APPLICATION NO. : 10/764928
DATED : April 26, 2005
INVENTOR(S) : Cannon It is certified that error appears in the above-identified patent and that said Letters Patent is hereby corrected as shown below:

In column 13, line 37, in Claim 2, after "BNC" delete ",".

Signed and Sealed this

Thirty-first Day of October, 2006

JON W. DUDAS
*Director of the United States Patent and Trademark Office*